US007055790B2

(12) United States Patent
Schröeter

(10) Patent No.: US 7,055,790 B2
(45) Date of Patent: Jun. 6, 2006

(54) DEVICE FOR SUPPORTING A DISPLAY SCREEN

(76) Inventor: Uwe Schröeter, Buchenhuegel 15, Ritterhude D-27721 (DE)

( * ) Notice: Subject to any disclaimer, the term of this patent is extended or adjusted under 35 U.S.C. 154(b) by 136 days.

(21) Appl. No.: 10/704,527

(22) Filed: Nov. 7, 2003

(65) Prior Publication Data

US 2005/0029420 A1 Feb. 10, 2005

(30) Foreign Application Priority Data

Nov. 7, 2002 (DE) ..... 202 17 312 U
May 20, 2003 (DE) ..... 203 08 014 U

(51) Int. Cl.
*A47H 1/10* (2006.01)

(52) U.S. Cl. ..... 248/323; 348/837

(58) Field of Classification Search ..... 248/323, 248/324, 327, 328, 329; 345/905; 312/7.2; 348/837, 836
See application file for complete search history.

(56) References Cited

U.S. PATENT DOCUMENTS 4,824,159 A * 4/1989 Fluharty et al. ..... 362/492
5,366,203 A * 11/1994 Huffman ..... 254/362
6,186,459 B1 * 2/2001 Ma ..... 248/276.1
6,292,236 B1 * 9/2001 Rosen ..... 348/837
6,361,012 B1 * 3/2002 Chang ..... 248/324
6,416,027 B1 * 7/2002 Hart ..... 248/324
6,484,993 B1 * 11/2002 Huffman ..... 248/323
6,557,812 B1 * 5/2003 Kutzehr et al. ..... 248/476

* cited by examiner

*Primary Examiner*—A. Joseph Wujciak
(74) *Attorney, Agent, or Firm*—Hahn Loeser & Parks, LLP; Robert J. Clark

(57) ABSTRACT

A ceiling mounting device for a display screen having a positioning mechanism constructed such that it enables the display screen to be positioned in the opening in its home position such that the back side of the flat panel display is essentially flush with the ceiling and an operating position wherein the display screen hangs generally vertically from the ceiling. The invention includes a pivoting mechanism to rotate the display screen when in its operating position in order to allow the display screen to be viewed from any location in the room.

7 Claims, 5 Drawing Sheets

DEVICE FOR SUPPORTING A DISPLAY SCREEN

This application claims the benefit of German patent application serial number 202 17 312.7, filed Nov. 7, 2002 and German patent application serial number 203 08 014.9 filed May 20, 2003, and are both hereby incorporated by reference.

TECHNICAL FIELD

The invention involves a roof/ceiling mounting device for a display screen, in particular a flat panel display, with a first positioning mechanism for positioning the display screen in its home position in an opening in the ceiling and/or behind the latter and in its operating position essentially hanging below the ceiling.

BACKGROUND OF THE INVENTION

Mounting devices for flat panel displays are known in various styles. There are several variations, where the flat panel display stands on a table, hangs on the wall or is fastened to the ceiling. However, the disadvantage to these options—especially with fastening the device to the wall or the ceiling—is that the spectators can only view the display screen from a particular section of a room or area.

Therefore, according to the invention we propose to provide a pivoting mechanism for rotating the display screen using a ceiling mounting device of the type described in the beginning. In its operating position this pivoting mechanism exhibits a rotational axis which is oblique with respect to the horizontal, preferentially essentially vertical.

SUMMARY OF THE INVENTION

In an embodiment of the invention, the ceiling mounting device of the present invention makes it possible to adjust a display screen—which is held by the ceiling mounting device—to the position of the viewer. Especially in areas such as in cabins or in areas in yachts which provide multiple seating options, such as a counter and a group of seats, it is advantageous to be able to rotate the flat panel display in order to be able to view it from any location in the room, as desired.

In an embodiment of the invention the positioning mechanism is constructed such that it enables the flat panel display to be positioned in the opening in its home position such that the back side of the flat panel display is essentially flush with the ceiling. This provides the advantage that the opening in the ceiling is closed in an aesthetic manner when the flat panel display is in its home position.

In an embodiment of the invention, the ceiling mounting device is equipped with a plate which essentially closes the opening made when the display is in the operating position. In order to position the plate, a second positioning mechanism can be provided, which works in connection with the first positioning mechanism such that it essentially positions the plate in the opening in the operating position and behind the opening in the home position. In a practical manner the second positioning mechanism creates a lifting motion of the plate. This plate guarantees an aesthetic closure of the opening in the operating position of the flat panel display.

In an embodiment of the invention, the first positioning mechanism exhibits a pivoted swiveling axis, to which a mounting device is attached in order to hold the display. The second positioning mechanism includes bearer cables on which the plate is hung and rollers for guiding the bearer cables. Roller sections for winding and unwinding the bearer cables are provided on the swiveling axis of the first positioning mechanism. Preferably the mounting device is created from the pivoting mechanism. In so doing, the rotational axis of the pivoting mechanism can be arranged so that it is at an angle, preferably at a right angle, to the swiveling axis of the first positioning mechanism. In a further advantageous embodiment the arrangement and guiding of the bearer cables and the formation of the roller sections on the swiveling axis of the first positioning mechanism are organized so that the swiveling motion of the swiveling axis of the first positioning mechanism essentially corresponds to the lifting motion of the plate. In this manner the power to pivot the flat panel display can simultaneously produce a synchronous lifting motion of the plate.

BRIEF DESCRIPTION OF THE DRAWINGS

Several embodiments of the present invention will be explained in more detail using the accompanying figures.

DETAILED DESCRIPTION OF THE INVENTION

Figure 1:
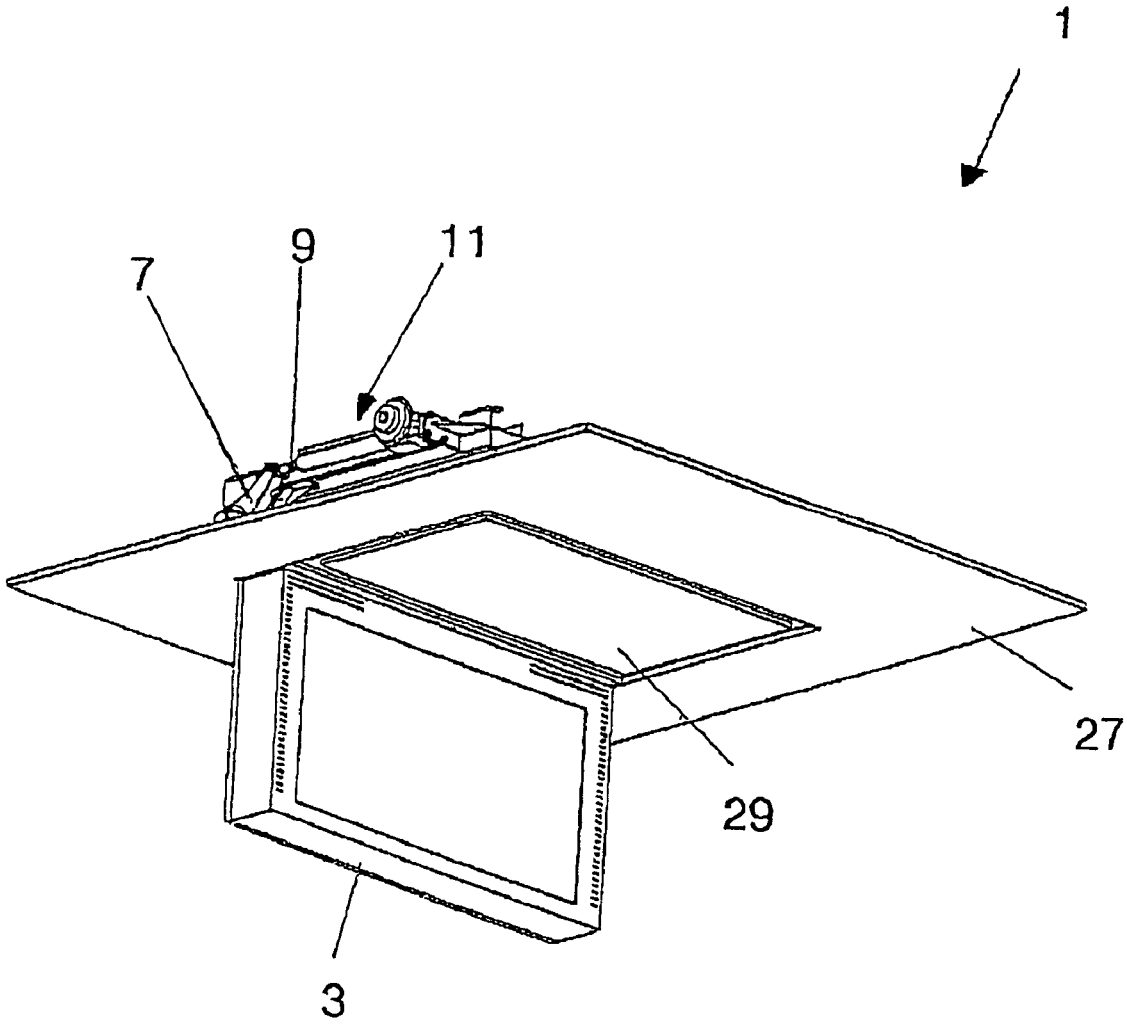
FIG. 1 shows a perspective view of the ceiling mounting device with a flat panel display rotated down in operating position.

FIG. 1 shows a perspective view of a ceiling mounting device 1 with a flat panel display 3, whereby the flat panel display 3 is rotated down in a possible operating position.

Figure 3:
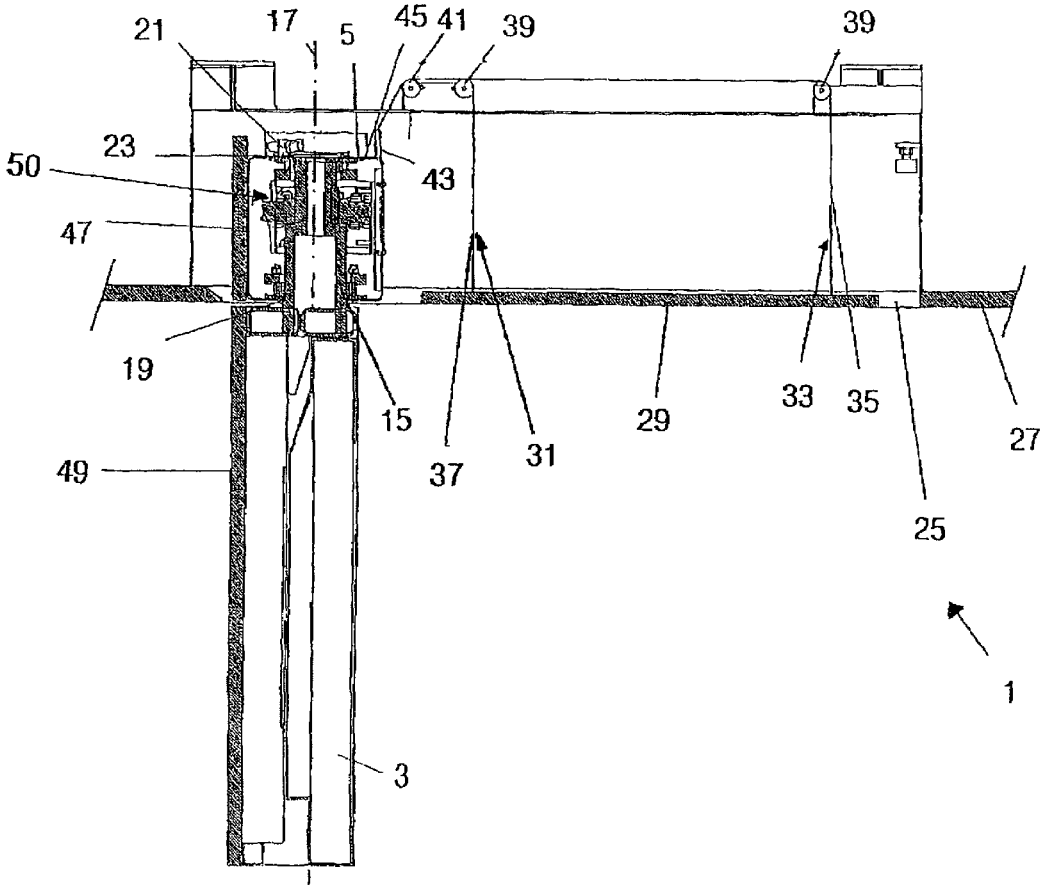
FIG. 3 shows a cross-section through the ceiling mounting device with the flat panel display in the operating position.

As can be seen in FIG. 3, the flat panel display 3 is mounted on a rectangular tube 5 along its upper edge. The rectangular tube 5 is pivoted around its longitudinal axis. Thus, for the flat panel display 3, the longitudinal axis of the rectangular tube 5 forms a swiveling axis 13 (FIG. 5), about which the flat panel display 3 can be pivoted. From FIG. 1 one can also recognize that a joint rod 7 is attached to the rectangular tube 5 so that it cannot be rotated radially. A drive rod 9 is linked at the free end of the joint rod 7, and the drive rod is moved in a reciprocal, translatory fashion by a motor 11. If the motor 11 is activated, the drive rod 9 moves in the direction of the joint rod 7, so that above the joint rod 7 the rectangular tube 5 is rotated 90°.

Figure 2:
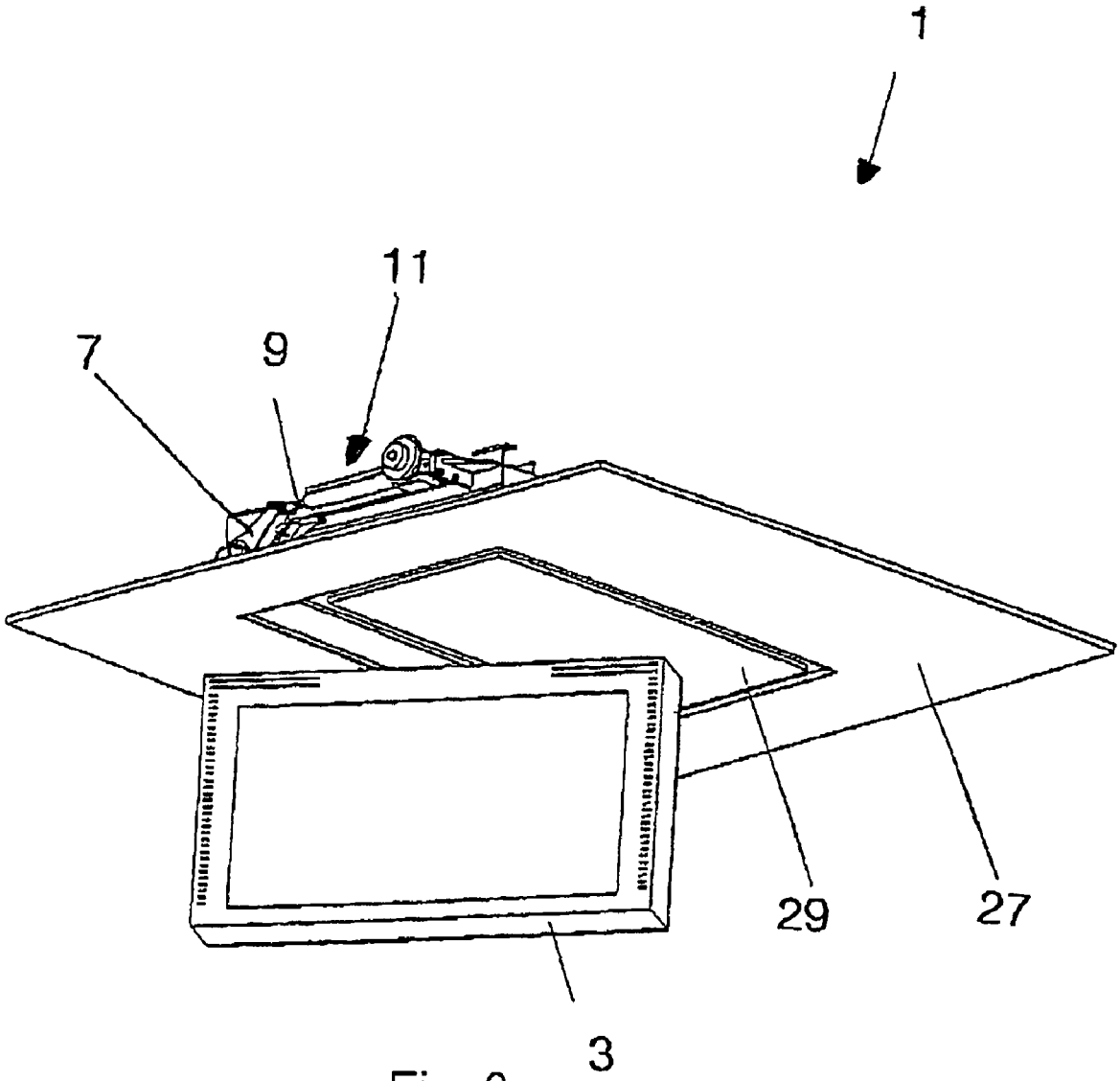
FIG. 2 shows a perspective view of the ceiling mounting device as per FIG. 1 with the flat panel display in a rotated operating position.
Figure 4:
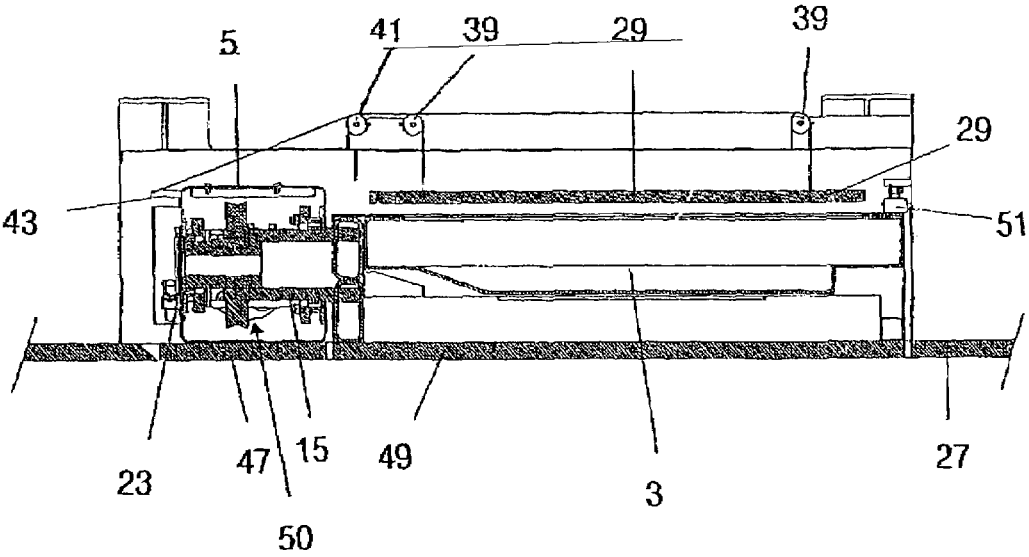
FIG. 4 shows a cross-section through the ceiling mounting device with the flat panel display in the home position.

As FIGS. 3 and 4 show, a hollow plug 15 is attached to the flat panel display 3. The hollow plug 15 is pivoted in a pivot rest 50, which is placed in the rectangular tube 5. The rotational axis 17 of the pivot rest 50 runs at a right angle to the swiveling axis 13 so that the flat panel display 3 can be rotated along the rectangular tube 5 about the vertical rotational axis 17 in the operating position; FIG. 2 shows the flat panel display 3 in one possible operating position, rotated about the rotational axis 17. Cables not shown in the figure, especially for power supply, antenna connection and/or a video device, are fed through the drill hole in the hollow plug 15. The flat panel display 3 is protected against falling out by means of a securing ring 23 on the side of the rectangular tube 5 which is opposite to the flat panel display 3, but it can be rotated 360°.

Figure 5:
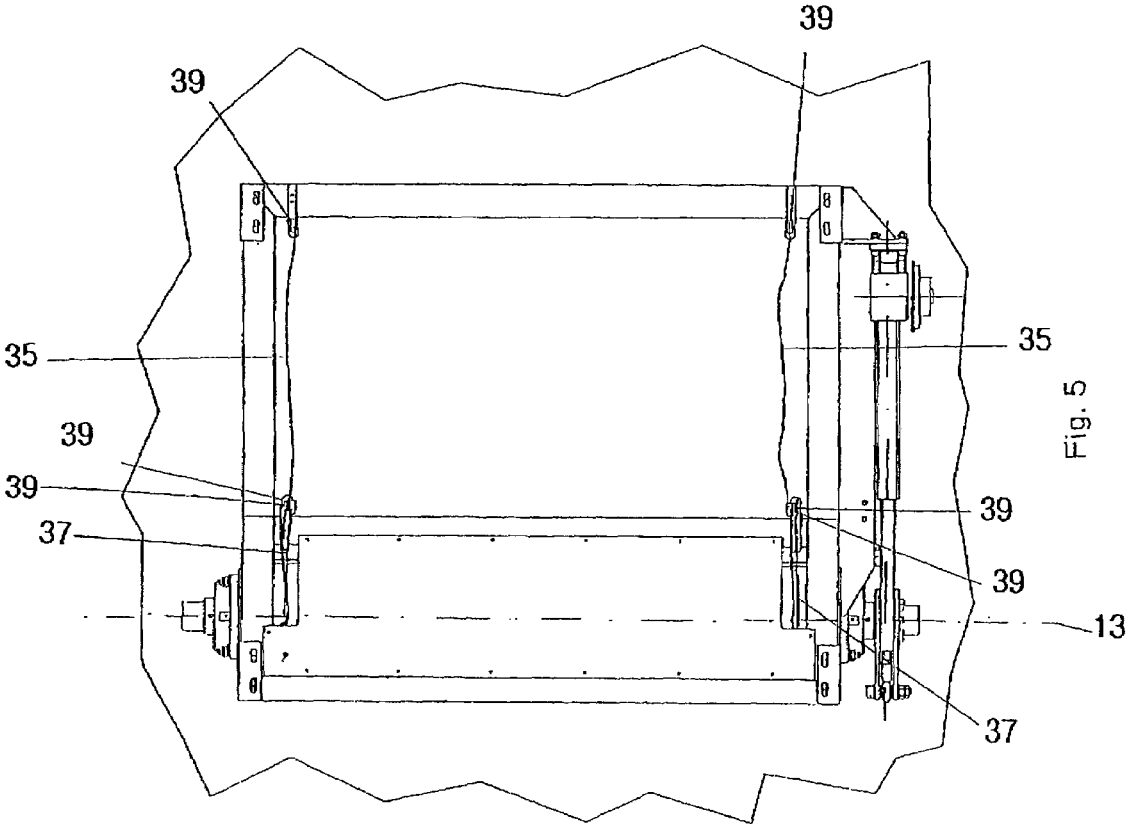
FIG. 5 shows a top view of the ceiling mounting device.

Plate 29 is designed to close in a ceiling covering 27 the opening 25 which is created when the flat panel display 3 is swung out. In the embodiment shown, the dimensions of the plate 29 are selected so that only a small gap remains open on all sides of the opening 25. In the home position, this plate 29 hangs above the flat panel display 3. If the flat panel display 3 is swung into its operating position, the plate lowers via four cable pulls 31, 33 into the opening 25 and closes the latter as completely as possible. Each cable 35, 37 of the cable pulls 31, 33 is attached to the various corners of the plate 29. Two cables 35, 37 run in series at right angles to the swiveling axis 13 (FIG. 5). At first each cable 35, 37 is directed over a roller 39 associated with each individual cable 35, 37 in the direction of the swiveling axis 13. Additional rollers 41 then provide additional winding of the cables 35, 37 in the direction of the rectangular tube 5. Two upright arms 43 are attached to the rectangular tube 5, on which the cables 33, 35 end and to which they are attached. Thus when the flat panel display 3 is pivoted between the home position and the operating position, for plate 29 this results in a synchronous impulse for moving the flat panel display 3. For example, if the rectangular tube 5 is rotated 90° when pivoting the flat panel display 3 from its home position into the operating position, then the plate 29 is raised or lowered correspondingly. If the flat panel display 3 is rotated from its home position into the operating position, the plate 29 drops into a closing position shown in FIG. 3, in which position the plate 29 is flush with the ceiling. Furthermore, FIGS. 3 and 4 demonstrate that the functional elements of the ceiling mounting device which are responsible for the movement of the plate 29 are also arranged and formed so that after the process of the plate 29 from the locked position to the home position, it is assured that the plate 29 has sufficient distance from the flat panel display 3 in home position.

The flat panel display 3 and the rectangular tube 5 both have a plate 47, 49 on the back side so that the opening 25 in the ceiling covering 27 is also closed aesthetically when the flat panel display 3 is in home position. Like plate 29, these plates 47, 49 are preferably similar to the ceiling covering 27 of an area. Thus, the placement of the flat panel display 3 behind the ceiling covering 27 is hardly noticeable. These plates 47, 49, 29 can be made for example from wood, metal or another material suitable for imitating a substance.

A stop 51 is mounted on the side of the opening 25 across from the rectangular tube 5. After being rotated into the home position, the flat panel display 3 rests against this stop 51. In this manner the flat panel display 3 is additionally secured and one is assured that the screen of the flat panel display 3 does not come into contact with the plate, which could lead to scratches or other damage to the screen.

The invention claimed is:

1. A ceiling mounting display screen apparatus comprising:

a display screen positioned in a recessed opening in a ceiling such that a back side of the display screen is flush with the ceiling, creating a home position of the display screen;

a first positioning mechanism, wherein the first positioning mechanism rotates the display screen between the home position and an operating position hanging below the ceiling such that the display screen and mounting bar are generally vertical with respect to the horizontal axis;

a pivoting mechanism, wherein the pivoting mechanism pivots the display screen about a rotational axis which is generally vertical with respect to the horizontal axis when the display screen is in the operating condition; and a cover plate, wherein the cover plate is moveable between a first position within the recessed opening when the display screen is in a home position to a second position flush with the ceiling when the display screen is in an operating position, wherein the majority of the recessed opening is no longer visible after the cover plate flush with the ceiling.

2. The ceiling mounting display screen apparatus of claim 1 further comprising a second positioning mechanism, wherein the second positioning mechanism moves the cover plate to a position generally flush with the ceiling when the display screen is in the operating position and retracts the cover plate within the opening in the ceiling when the first positioning mechanism moves the display screen to the home position.

3. The ceiling mounting display screen apparatus of claim 2, wherein the second positioning mechanism creates a lifting motion of the cover plate.

4. The ceiling mounting display screen apparatus of claim 2, wherein:

the first positioning mechanism comprises a pivoted swiveling axis member to which a mounting device is fastened in order to hold the display screen;

the second positioning mechanism comprises cables on which the cover plate is hung, and rollers for guiding the cables; and wherein the pivoted swiveling axis of the first positioning mechanism further comprises a plurality of roller sections for winding and unwinding the cables.

5. The ceiling mounting display screen apparatus of claim 4, wherein the mounting device of the first positioning mechanism is formed from the pivoting mechanism.

6. The ceiling mounting display screen apparatus of claim 5, wherein the rotational axis of the pivoting mechanism is positioned transverse to the swiveling axis of the first positioning mechanism.

7. The ceiling mounting display screen apparatus of claim 4, wherein the arrangement and guiding of the cables and the formation of the roller sections on the swiveling axis of the first positioning mechanism are established such that the pivoting movement of the swiveling axis of the first positioning mechanism essentially corresponds to the lifting motion of the cover plate.

* * * * *